US005797610A

United States Patent [19]

Grande et al.

[11] Patent Number: 5,797,610

[45] Date of Patent: Aug. 25, 1998

[54] VENTILATED IN-LINE SKATE

[75] Inventors: Dodd H. Grande, Seattle, Wash.; Antonin A. Meibock, Calgary, Canada; John E. Svensson, Vashon, Wash.

[73] Assignee: K-2 Corporation, Vashon, Wash.

[21] Appl. No.: 799,858

[22] Filed: Feb. 13, 1997

[51] Int. Cl.[6] ..... A63C 17/06

[52] U.S. Cl. ..... 280/11.22; 280/811

[58] Field of Search ..... 280/11.22, 811; 36/3 A, 3 B, 3 R, 7.1 R, 10, 45, 55, 89, 115

[56] References Cited

U.S. PATENT DOCUMENTS

| | | | |
|---|---|---|---|
| 4,507,880 | 4/1985 | Ohashi | 36/115 |
| 4,860,463 | 8/1989 | Pin | 36/3 B |
| 5,171,033 | 12/1992 | Olson et al. . | |
| 5,342,070 | 8/1994 | Miller et al. | 36/3 A |
| 5,365,677 | 11/1994 | Dalhgren | 36/3 A |
| 5,401,039 | 3/1995 | Wolf | 280/11.22 |
| 5,437,466 | 8/1995 | Meibock et al. . | |
| 5,515,622 | 5/1996 | Lee | 36/3 B |

FOREIGN PATENT DOCUMENTS

| | | | |
|---|---|---|---|
| 177905 | 11/1906 | Germany | 36/3 R |
| 53447 | 10/1967 | U.S.S.R. | 36/3 R |
| 2019194 | 10/1979 | United Kingdom | 36/3 B |

*Primary Examiner*—Stephen Avila
*Assistant Examiner*—Clovia Hamilton
*Attorney, Agent, or Firm*—Christensen O'Connor Johnson & Kindess PLLC

[57] ABSTRACT

A ventilated in-line skate (10) includes a lower frame portion (12) mounting a plurality of wheels (14) and an upper shoe portion (16). The upper shoe portion is secured to a base (24) that defines an upper surface (26) adapted to receive the upper shoe portion (16), and an exterior, lower surface (28) to which the lower frame portion (12) is secured. The base defines multiple ventilation channels (30) that traverse its upper surface (26) from a corresponding plurality of inlet apertures (32, 39) to an outlet aperture (34) defined within the exterior surface of the base. The upper surface of the base receives a last board (54) and insole (58), each of which includes a plurality of vertical apertures that permit airflow from the interior of the upper shoe portion to the ventilation channel. The base draws air and moisture from the interior of the upper shoe portion during use.

38 Claims, 6 Drawing Sheets

38
34
52
24
28
30
39
44
39
44
52
39
39
44
44
32
32
36

VENTILATED IN-LINE SKATE

FIELD OF THE INVENTION

The present invention generally relates to sport shoe construction and, in particular, to ventilated in-line roller skates.

BACKGROUND OF THE INVENTION

An in-line roller skate generally includes an upper shoe portion secured by a base to a frame that carries the wheels. The upper shoe portion provides the support for the skater's foot, while the frame provides for journalling of the wheels along a common longitudinal axis. The upper shoe portion, or boot, of the skate is often constructed of rigid molded plastic, which receives a removable liner. The frame may be integrally molded with the boot. In one type of conventional skate disclosed in U.S. Pat. No. 5,177,033 to Olson et al., the boot includes a series of apertures along the side and top of the boot, providing a limited degree of ventilation for only the top and side of the skater's foot.

The molded plastic design of the traditional in-line skate has several aspects that detract from the comfort and use of the skate. In-line skating is an active sport, and a user's feet typically perspire. Conventional in-line skates, with a foam liner and plastic boot, trap moisture, making the user's foot damp and uncomfortable. Ventilation apertures formed along a side and top of the foot provide heat transfer and drying for only those underlying areas of the foot, but fail to provide heat and moisture transfer for the remainder of the foot, including along the sole of the foot. Additionally, this traditional ventilation design fails to provide an adequate way of drawing moisture away from the skater's foot and expelling it out from the skate, and thereby does not provide a dry and comfortable environment for the skater's foot.

One partial solution to the inadequate ventilation and moisture removal of conventional skates is proposed by U.S. Pat. No. 5,401,034 to Wolf This skate includes an impeller mounted within a shroud on the side of the skate frame. Air from the impeller is routed to the underside of the skate upper through a duct opening into an aperture formed in the underside of the boot. Air is thus forced into the interior of the boot. An outlet is provided in the upper heel of the boot for exhaust. This design is not only cumbersome, but does not ventilate the majority of the length of the sole of the foot, and does not draw moisture out from the skate interior.

Another solution is provided by U.S. Pat. No. 5,437,466 to Meibock et al., which utilizes a breatheable fabric upper that is secured to a rigid base to which the frame is attached. The flexible upper is supported by a rigid heel cup and pivoting ankle cuff. The upper portions of the foot are ventilated through the fabric, but the sole of the foot, which overlies the rigid base, is not ventilated.

SUMMARY OF THE INVENTION

The present invention is directed to a ventilated sport shoe, such as an in-line roller skate. The ventilated skate of the present invention has an upper shoe portion adapted to receive a skater's foot and a lower frame portion that includes a plurality of wheels. The skate includes a foot bed, the foot bed including a base secured to the upper shoe portion. The foot bed defines an upper surface capable of receiving the skater's foot, while the base defines a lower surface defining a mounting surface for the lower frame. The base includes at least one inlet aperture and at least one outlet aperture formed in an exterior surface of the base. A ventilation channel defined by the foot bed within or below the upper surface of the foot bed extends from the inlet aperture to the outlet aperture to at least partially traverse the upper surface of the foot bed. The channel is in fluid flow communication with the interior of the upper shoe portion underneath the skater's foot, and provides ventilation and moisture transfer from the skater's foot to the channel and out the outlet aperture.

In a further aspect of the invention, the ventilated skate of the present invention includes an insole and a last board. The insole includes a plurality of vertically extending apertures capable of pulling moisture away from the skater's foot. The last board includes a plurality of vertical apertures extending therethrough, thereby providing vertical ventilation through the last board. Other mechanisms of moisture management and transport may be utilized within the scope of the present invention, such as wicking through the last board and/or insole. In a preferred embodiment, the upper shoe portion is mounted to the base by the last board. The ventilation channel is defined in an upper surface of the base. An insole overlies the last board, which overlies the base. Moisture transport pathways are thus defined through the insole and last board to the ventilation channel in the base. As the underside of the last board is cooled by airflow through the channels, a moisture gradient is created through the last board and insole, drawing water vapor downwardly into the ventilation channel.

In a preferred embodiment of the invention, a plurality of inlet apertures are defined in the exterior of a toe end of the base, while the exterior of the heel end of the base defines a plurality of corresponding outlet apertures. The inlet and outlet apertures are connected by a plurality of channels traversing the length of the upper surface of the base and that are spaced across the width of the upper surface, thereby providing continuous ventilation and moisture transfer for substantially the entire length and width of the skate. The channeling in the upper surface of the base also provides for the continuous cooling of the bottom of the foot. Finally, the continuous airflow underneath the foot pulls moisture down from the skater's foot through the insole, and out the outlet, thereby providing a cool, dry, and comfortable environment for the skater's foot.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
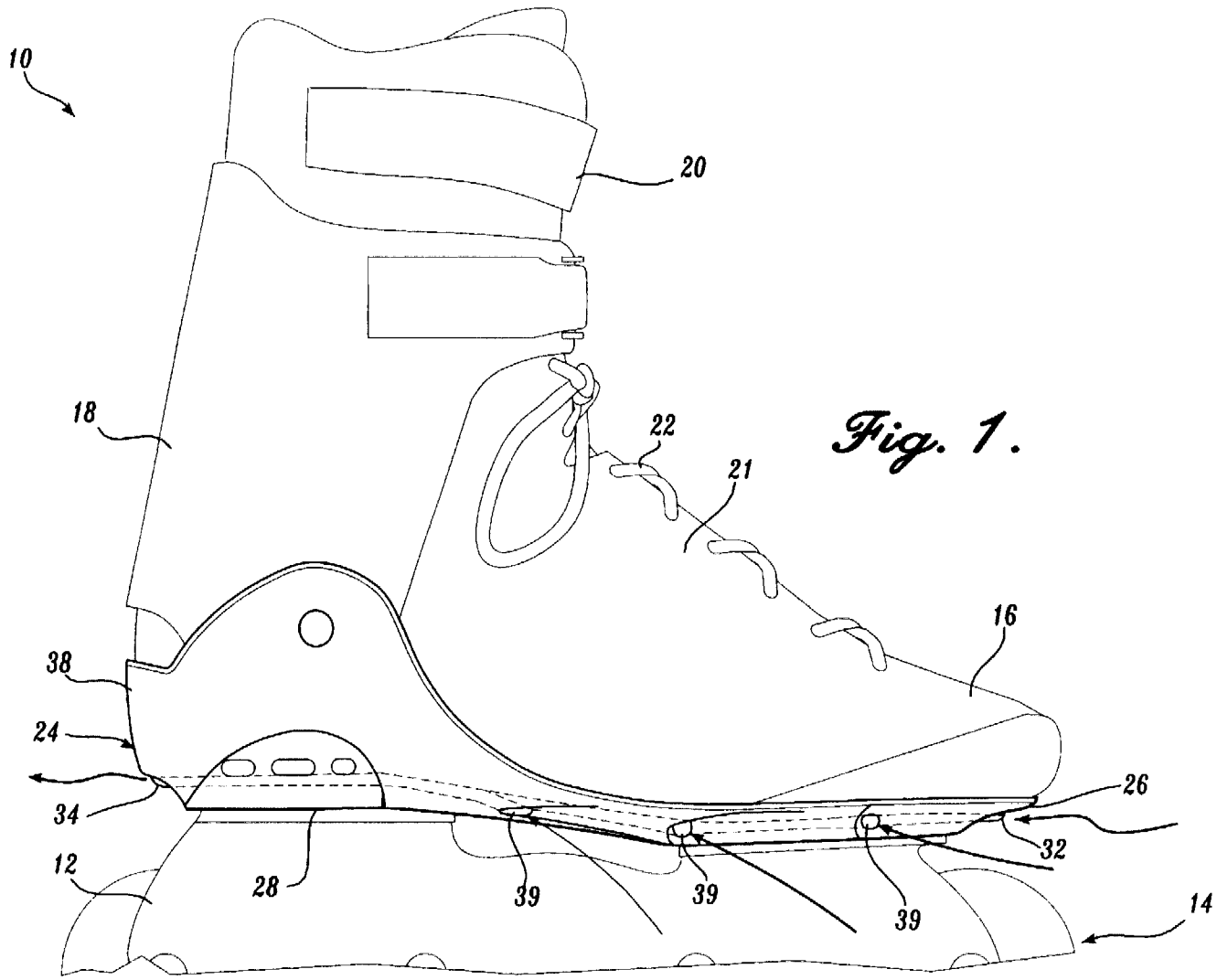
FIG. 1 represents a side view of a preferred embodiment of a ventilated skate in accordance with the present invention.

Referring to FIG. 1, a ventilated sport shoe constructed in accordance with a first preferred embodiment of the present invention is illustrated in the form of an in-line skate 10. The skate 10 includes a lower frame portion 12, bearing members in the form of wheels 14, and an upper shoe portion 16 adapted to receive a foot (not shown). The skate 10 includes a foot bed for supporting the foot, including a base 24, to be described below, and an ankle support cuff 18 pivotally attached to the base 24. The ankle support cuff 18 projects upwardly and defines a shell that provides physical support for the ankle of the received foot. Securing straps 20 or buckles are provided on an uppermost shin portion of the upper shoe portion 16, for fastening the upper shoe portion 16 around the shin. The upper shoe portion 16 includes a conventional vamp 21 and vamp closure, including a lace 22 traversing the top of the foot from the toe area of the foot to the shin of the foot.

Figure 2:
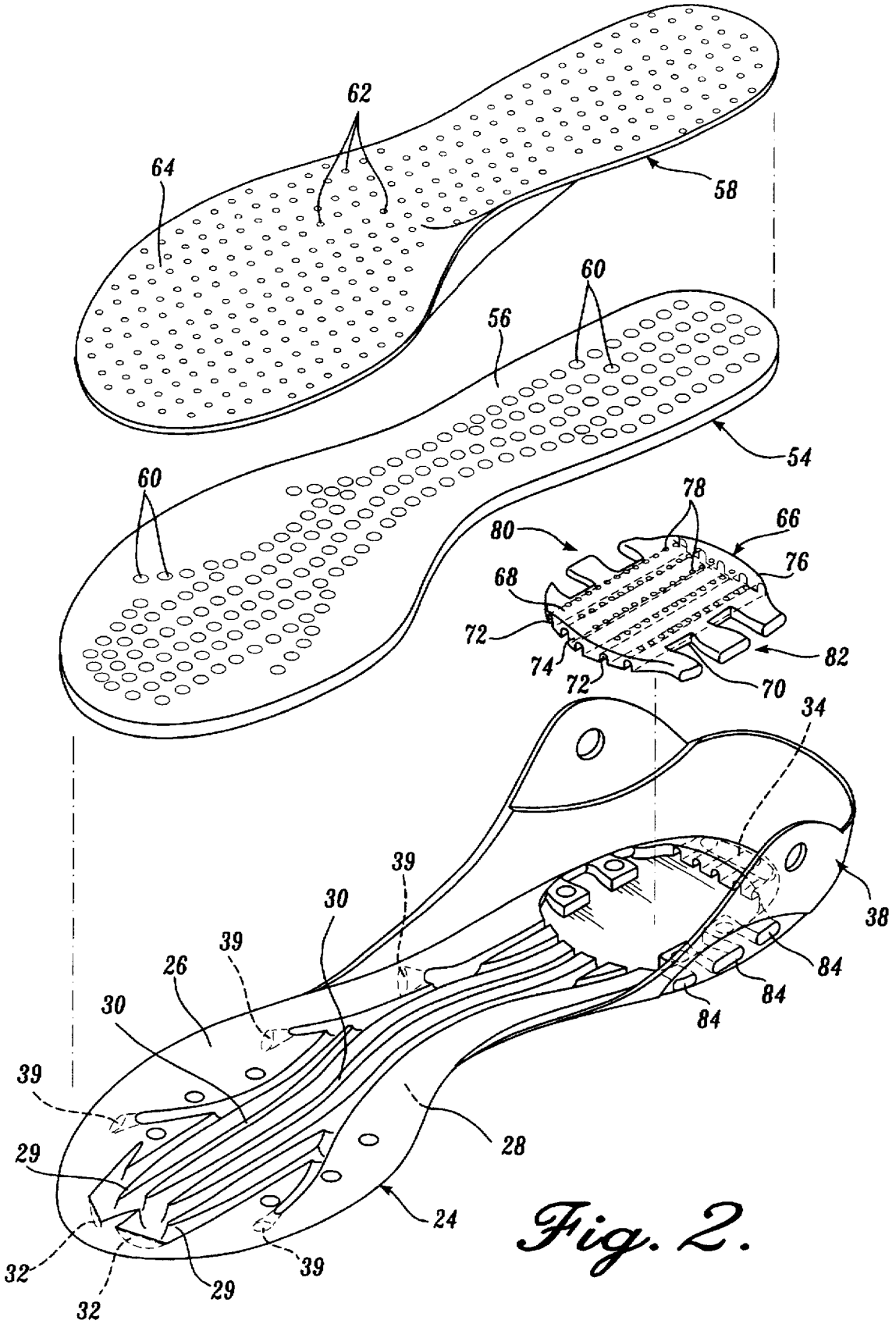
FIG. 2 is an exploded pictorial view of the ventilated skate base assembly of FIG. 1.

Attention is now directed to FIG. 2 for understanding of the ventilation base 24 of the shoe 10. The base 24 defines an upper surface 26 that receives the sole of the foot and an exterior, lower surface 28 that defines a mounting interface between the lower frame 12 and the upper shoe 16. The base 24 further defines a plurality of ventilation channels 30 that at least partially traverse the upper surface 26 of the base 24, and which in the preferred embodiment illustrated traverse the full length of the upper surface 26. The base 24 also includes on its exterior a plurality of inlet apertures 32 and an outlet aperture 34 defined by the forward (i.e., toe end) and rearward (i.e., heel end) ends, respectively, of the ventilation channels 30.

Figure 3:
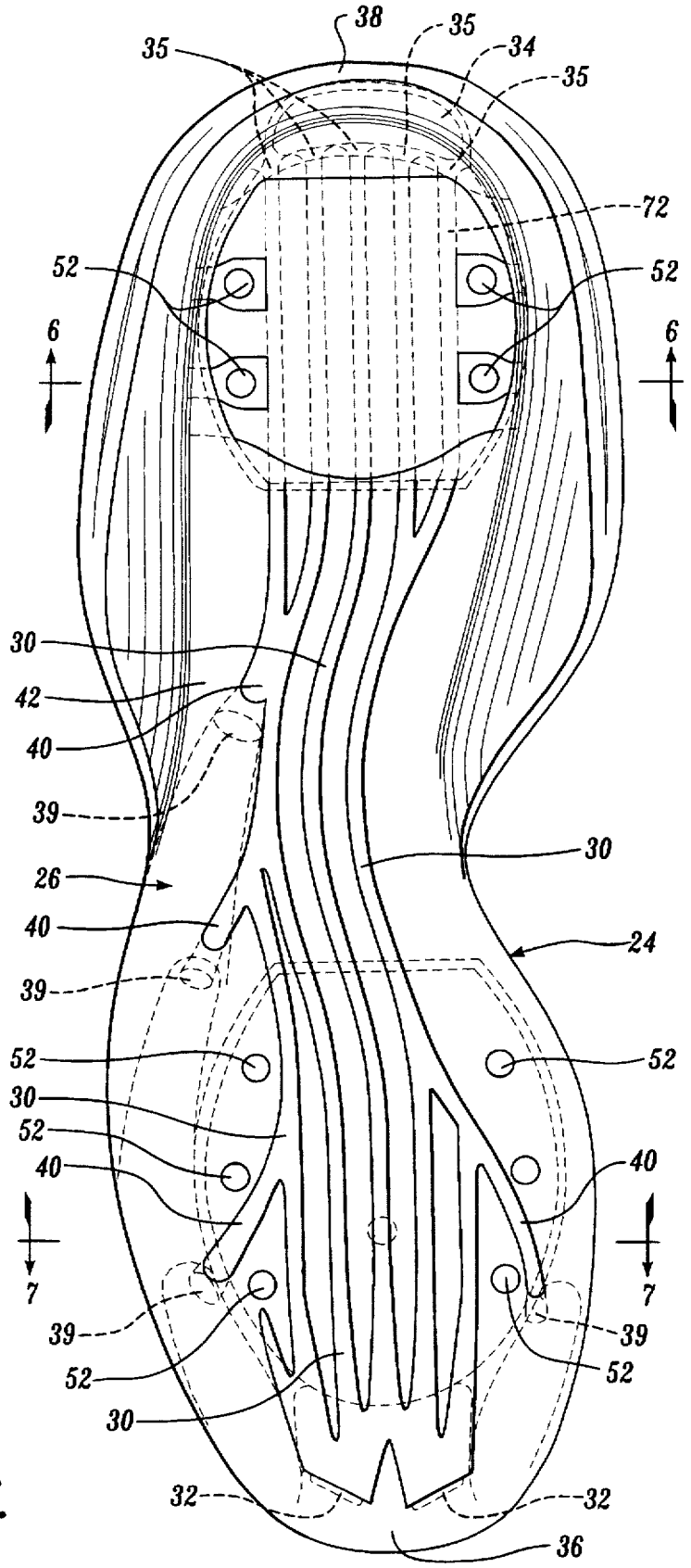
FIG. 3 is a top plan view of the ventilated skate base of FIG. 1.

FIG. 3 provides further detail of the arrangement of the ventilation channels 30. The base 24 is suitably manufactured from a rigid plastic, such as a polyamide. Preferably, the base 24 is formed as a one-piece molding. Two inlet apertures 32 are arranged side by side to span substantially the entire width of the forward end of the toe area 36 of the base 24. The inlet apertures 32 are formed in the lower surface 28 just below the junction with the upper surface 26 of the base 24. The inlet apertures 32 are oriented substantially normal to the airflow when the skate 10 is in use. Each inlet aperture 32 feeds two longitudinal ventilation channels 30, while a fifth, centrally disposed longitudinal ventilation channel 30 is fed by both inlet apertures 32. While two inlet apertures 32 are illustrated in the preferred embodiment, more or fewer apertures are also within the scope of the present invention.

Additional side inlet apertures 39, to be described in greater detail later, are defined on both sides of the base 24 within the lower surface 28 thereof. Each side inlet aperture 39 feeds a branch ventilation channel 40, which extends rearwardly and inwardly to join an adjacent one of the longitudinal ventilation channels 30. In the preferred embodiment, there are three side inlet apertures 39 sequentially spaced along the outer metatarsal head area and instep area of the base 24, and one side inlet aperture defined along the inner metatarsal head area of the base 24. While the plurality of side inlet apertures described above are the preferred embodiment, more or fewer inlet apertures are also within the scope of the present invention.

Still referring to FIG. 3, a single outlet aperture 34 is defined in the heel area 38. The outlet aperture 34 is configured as a manifold that joins and is common to all of the individual outlets 35 of the ventilation channels 30. The outlet aperture 34 is formed in the lower surface 28 just below the junction with the upper surface 26 of the base 24. (The outlet aperture 34 substantially spans the width of the heel area 38 of the base 24. While the preferred embodiment of the present invention is shown as including one manifold outlet aperture 34, additional outlet apertures defined along the base 24 are also within the scope of the present invention. The outlet aperture 34 is longitudinally spaced from the inlet apertures 32 along the length of the base 24.

The inlet aperture 34, side inlet apertures 39, and the outlet aperture 34 are connected by multiple corresponding ventilation channels 30 running the length of the base 24, thereby providing continuous airflow for substantially the entire length of the skate 10. Each channel 30 is preferably formed as a U-shaped groove, recessed within the upper surface 26 to approximately midway between the upper surface 26 and the lower surface 28 of the base 24. Although open groove-like channels are included in the preferred embodiment to provide airflow, enclosed, tubular passages (not shown) defined within the base 24 and connected to the upper surface 26 by multiple apertures (not shown) are also within the scope of the present invention.

Referring to FIGS. 2 and 3, the channels 30 are preferably formed along the entire length of the base 24. Preferably, multiple channels 30 are provided and are spaced laterally to provide airflow through the majority of the upper surface 26 of the base 24. A plurality of ribs 29 are defined in the upper surface 26 between the channels 30. The ribs 29 are defined by the sidewalls of the channels 30, with the channels 30 and ribs 29 being alternately spaced across substantially the entire width of the base 24. While multiple full-length channels 30 are preferred, fewer or more than shown is also within the scope of the invention. As a nonlimiting example, a single channel with a plurality of branches that are used to connect a plurality of inlets and outlets (not shown) are also within the scope of the present invention.

Referring to FIG. 3, in the preferred embodiment illustrated, five longitudinally extending channels 30 are provided from the toe portion 36 to the heel portion 38 of the base 24. The channels 30 are oriented generally parallel to each other and the longitudinal axis of the base 24. In the narrowest, instep region of the base 24, the two outermost channels 30 temporarily converge, and then separate within the heel portion of the base 24. Likewise, the two innermost channels 30 also temporarily converge in the instep region of the base 24.

Operationally, the channels 30 and corresponding inlet and outlet apertures not only provide continuous ventilation for the entire length of the foot, but also for substantially the entire width of the foot, thereby providing complete ventilation for the sole. The construction of the upper shoe portion 16 also aids in the ventilation and moisture transfer of the present invention. The upper shoe portion 16 is preferably at least partially manufactured of a breatheable material, such as a woven fabric, as disclosed in U.S. Pat. No. 5,437,466 issued to Meibock et al., the disclosure of which is hereby expressly incorporated. The breatheable materials used to construct the upper shoe portion 16 aid in the ventilation of the interior of the upper shoe portion 16 by ensuring that air continually circulates and flows from the interior of the upper shoe portion 36 to the ventilation channels 30.

Figure 4:
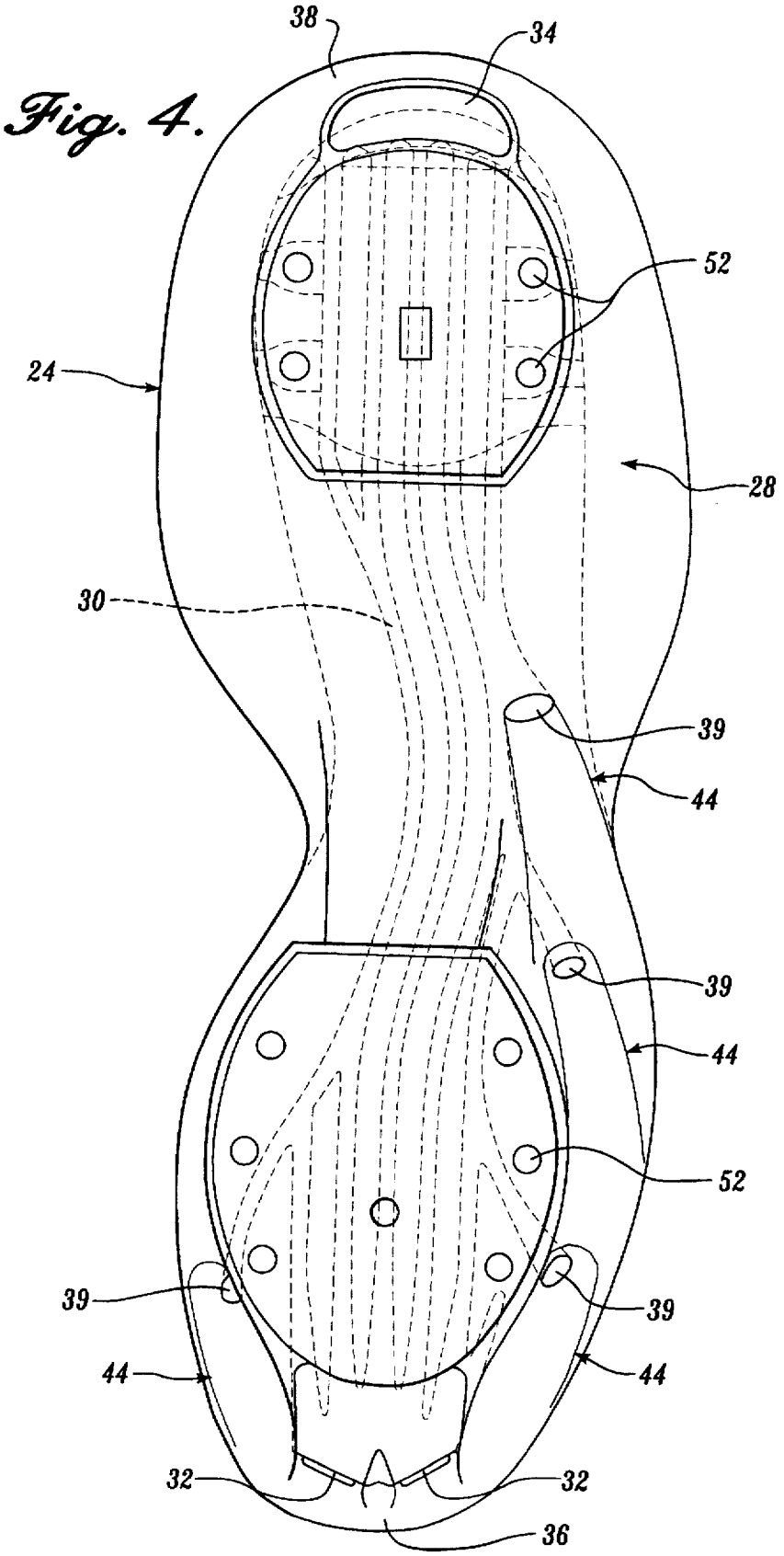
FIG. 4 is a bottom plan view of the ventilated skate base of FIG. 1.

Referring to FIG. 4, the lower surface 28 of the base 24 defines integrally molded projections 44 that extend downwardly from the lower surface 28. The projections 44 are sequentially spaced from the toe area 36 to the midsole area 42 of the base 24. The projections 44 each have a forward end 46 defining a forward facing surface 48. As may also be seen in FIG. 5, a scallop-like trough formed in the lower surface 28 feeds each projection 44, thereby defining a sequence of funnel-like structures to capture the freestream air during use of the sport shoe 10.

Figure 5:
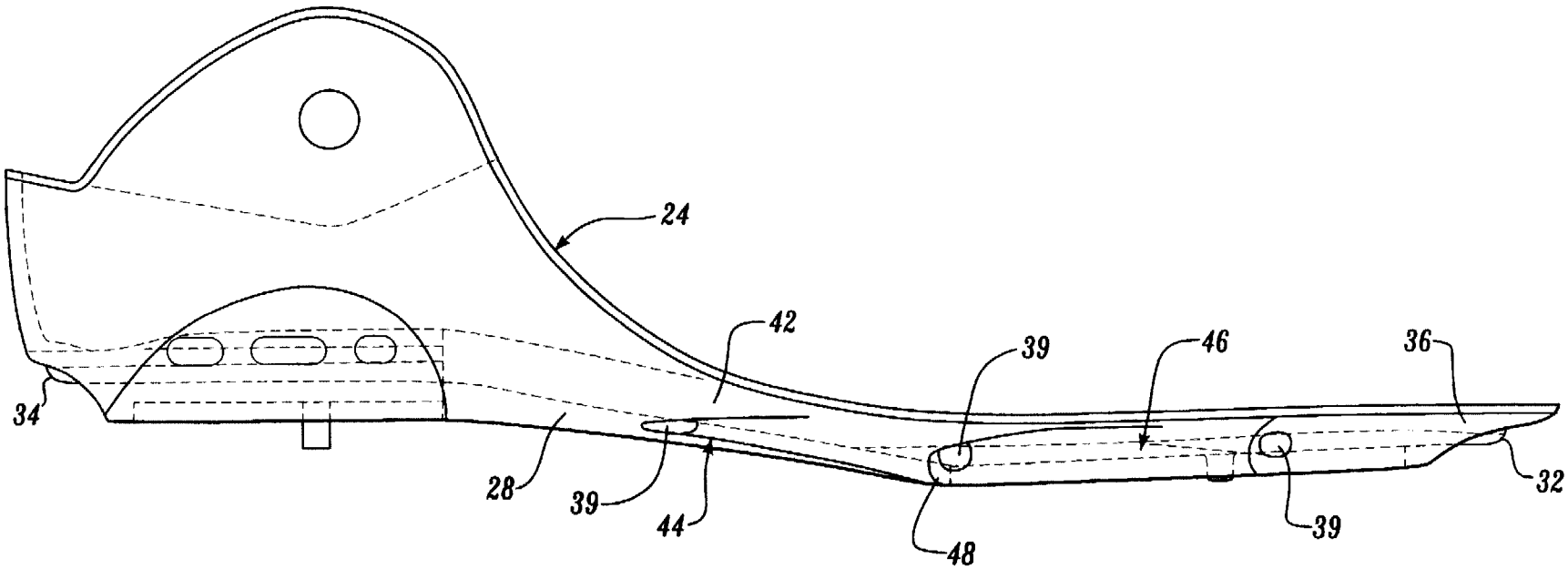
FIG. 5 is a side view of the ventilated skate base of FIG. 1.

Still referring to FIG. 5, a side inlet aperture 39 is defined within each projection 44 on the forward facing surface 48 thereof The side inlet apertures 39 are positioned normal to the freestream airflow, thereby drawing additional airflow through the channels 30 as the skate 10 moves in use.

Referring back to FIG. 4, the lower frame 12 is secured to the base 24 by a plurality of rivets 50 (FIG. 6), installed through rivet holes 52 formed in the base, and adhesives. Although rivets are the preferable means of joining the lower frame 12, other retention methods, such as screws, are also within the scope of the present invention. A plurality of longitudinally aligned wheels are journalled on the lower frame 12 along a common longitudinal axis. In operation, cooling and drying of the skater's foot are accomplished by the strategic placement of the ventilation apertures and channels 30 underneath the skater's foot to provide continuous airflow therethrough.

More specifically, the cooling and drying of the skater's foot may be more readily understood by referring back to FIG. 2. A ventilated last board 54 overlies the upper surface 26 of the base 24, and secures the upper portion 16 to the base 24. The last board 54 is constructed from a compressed, fibrous material. The last board 54 defines an upper surface 56 and receives an overlying cushioned, ventilated insole 58. The upper surface 64 of the insole 58 cradles a user's foot. The insole 58 is preferably constructed from a fibrous wicking material defining internal moisture transport pathways, but alternately may be constructed from a perforated foamed elastomer. Either a wicking material, or perforations, or both may be utilized for moisture transport pathways.

The last board includes a plurality of apertures 60 vertically extending therethrough, or alternately is constructed of a fibrous wicking material defining internal moisture transport pathways, in lieu of, or in conjunction with, the apertures 60. The apertures 60 of the last board 54 are disposed so that at least some of the series of apertures 60 are aligned with the channels 30 along the length of the channels 30. At least some of the apertures 60 further align with some of an array of vertically extending apertures 62 formed in the insole 58. The last board 54 and the insole 58 each serve as a moisture transport substrate for the skater's foot and complete the lower interior of the skate 10 so as to provide substantially unobstructed and even ventilation and airflow to the channels 30.

Operationally, the vertical alignment of the insole apertures 62 with the last board apertures 60 defines unobstructed vertical passages for ventilation and moisture transfer from the skater's foot directly to the channels 30 and out the outlet apertures 34 of the base 24. Perfect alignment of the ventilation apertures is not necessary, when a fibrous, wicking insole is utilized, because the insole (and the last board, if fibrous) wicks moisture both vertically and laterally. A moisture gradient is created from the upper surface of the insole 58, which receives perspiration, to the lower surface of the last board 54, which is cooled and dried by airflow through the ventilation channels 30, causing moisture vapor and liquid to be drawn downwardly. Moisture is thus transported from the received foot through the foot bed, consisting of the insole 58, the last board 54, and the base 24, to the channels 30 in a substantially uninhibited manner.

Referring to FIG. 2, the upper surface 26 of the base 24 preferably includes an elastomeric inlay 66 that is insertable into a heel cup portion 38 of the base 24. The inlay 66 is constructed of a cushioning elastomeric material, such as a polyurethane or silicone elastomer, and defines an upper surface 68 that is capable of receiving the heel of the skater's foot. The inlay 66 absorbs shock between the ground and the user during use. The inlay 66 also defines a lower surface 70 defining a plurality of longitudinal grooves 72. The grooves 72 extend from a front end 74 of the inlay 66 to a back end 76 of the inlay 66. The inlay 66 also defines a plurality of vertically extending apertures 78 at least partially aligned with the longitudinal grooves 72, thereby providing ventilation through the inlay 66 to the grooves 72. The grooves 72 longitudinally align with the channels 30 of the base 24, and form a longitudinal portion of the channels 34 through the heel region of the base 24. Thus, cushioning of the heel is provided without interfering with the unobstructed ventilation and moisture transfer from the interior of the upper shoe portion 16 to the outlet aperture 34. The inlay 66 also includes a first set of outwardly projecting plugs 80 and a second set of outwardly projecting plugs 82 defined along opposing side edges of the inlay 66. The plugs of the inlay 66 extend to the exterior of the base 24 when the inlay 66 is received therein, through a corresponding plurality of slots 84 defined in the heel cup portion 38 of the base 24.

Figure 6:
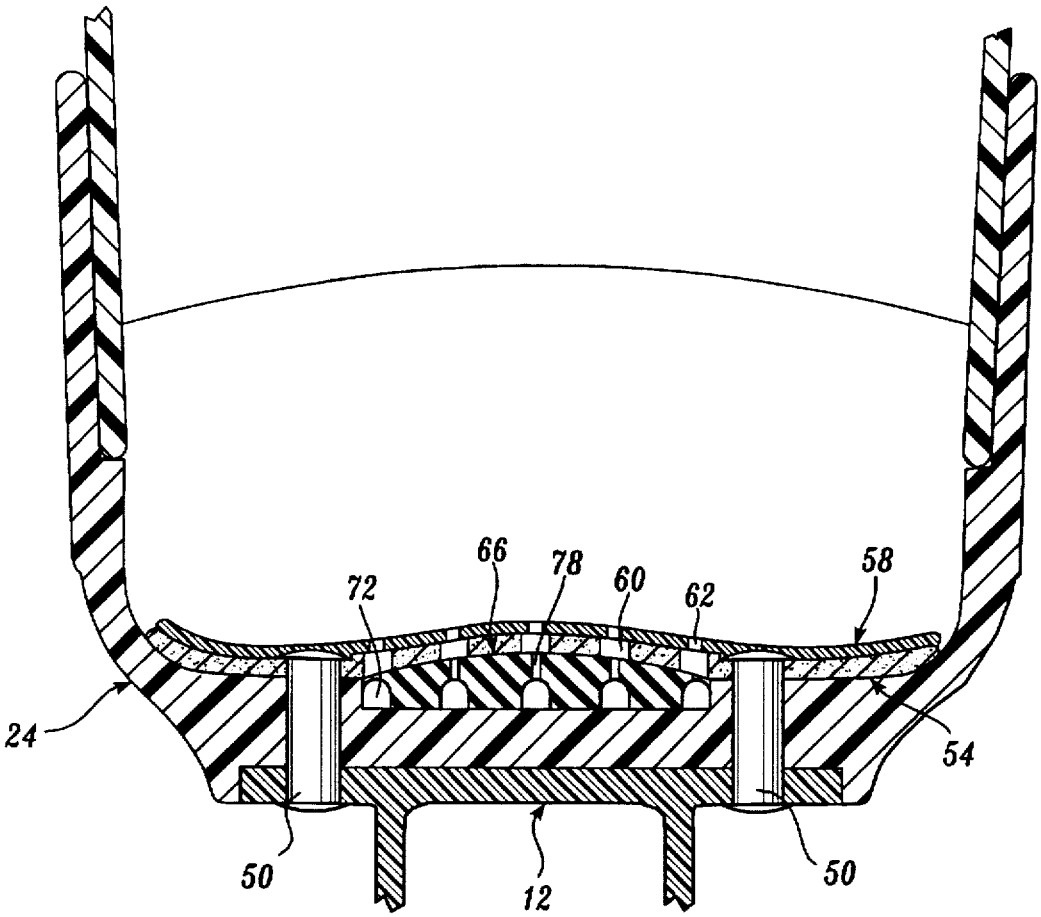
FIG. 6 is a cross-sectional end view of the heel portion of the ventilated skate base taken substantially along section 6—6 of FIG. 3.

FIG. 6 is a cross-sectional view through the heel cup portion 38 illustrating the operation of the ventilated base 24 in accordance with the present invention. The insole's apertures 62, the last board's apertures 60, the inlay's apertures 78, and the inlay's longitudinal grooves 72 all align in a vertical direction to define continuous moisture transfer and ventilation passages from the foot to the grooves 72.

Figure 7:
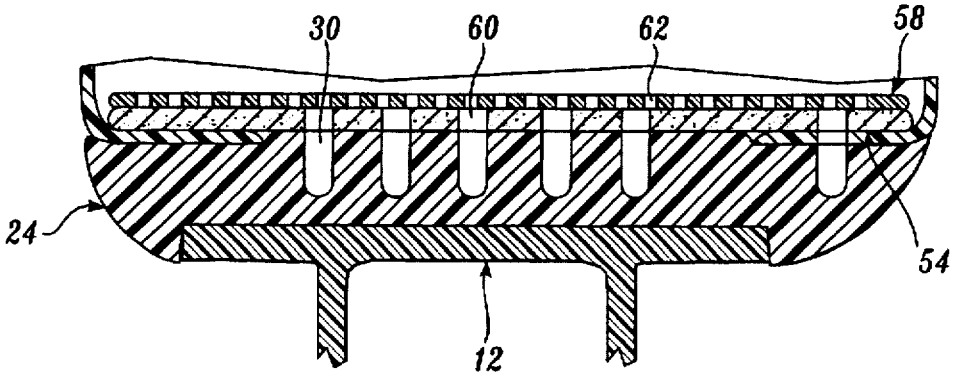
FIG. 7 is a cross-sectional end view of the toe portion of the ventilated skate base taken substantially along section 7—7 of FIG. 3.

FIG. 7 is a cross-sectional view through the toe end of the base 24 illustrating the vertical alignment of at least some of the apertures 62 of the insole 58 and the apertures 60 of the last board 54 with the channels 30 of the base 24. Thusly aligned, there are a plurality of continuous passages defined from the foot to the channels 30, which combined with the preferred wicking characteristics of the insole and last board, provide moisture transfer and ventilation to the foot. Referring back to FIG. 3, the grooves 72 of the inlay (shown in phantom) longitudinally align with the channels 30 of the base 24 to define a continuous airflow and moisture transfer passage for the entire length of the base 24. The channels 30 are connected to the inlet aperture 32 at the front of the base 24, while the grooves 72 connect to the outlet aperture 34. Therefore, during operation, airflow enters the base 24 through the inlet aperture 32, travels along the channels 30, drawing moisture down from the insole 58 through the last board 54, and exhausting out the outlet aperture 34. The series of side inlet apertures 39 provide additional airflow into the channels 30 along the length of the base 24. Thus, there is continuous moisture transfer and ventilation passage along the entire length of the base 24 for the foot received within the upper shoe portion 16.

The preferred embodiment of the skate 10 utilizes channels 30 formed in the upper surface of the base 24. It should be apparent to those of ordinary skill that the channels 30 could alternately be formed partially or completely through other components of the foot bed. For example, the channels 30 could be formed as grooves in the lower surface or upper surface of the last board 54, which communicate with inlet and outlet ports formed in the base 24.

While the preferred embodiment of the invention has been defined in terms of a skate 10, the ventilated base 24 of the present invention is also suitable for other sport shoes, particularly summer sport shoes, such as biking shoes. Operationally, the flowthrough ventilation of the present invention is easily adapted to the sole of a biking shoe with the lower frame 12 replaced by a bearing surface adapted to receive the pedal of a bicycle.

The previously described versions of the present invention have many advantages, including the following. First, the ventilation channels of the present invention provide for ventilation and heat transfer for the entire length of the skate. The channeling and the upper surface of the base also provide for continuous cooling for the bottom of the foot. Finally, the continuous airflow underneath the foot pulls moisture down from the skater's foot, through the insole, and out the outlet, thereby providing a cool, dry, and comfortable environment for the skater's foot.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A ventilated sport shoe including a lower frame portion mounting a bearing member, wherein the ventilated sport shoe comprises:

an upper shoe portion defining an interior adapted to receive a foot; and a foot bed including a base secured to the upper shoe portion, the foot bed defining an upper surface capable of receiving the foot and the base defining a lower surface capable of mounting the lower frame thereon, the foot bed defining a ventilation channel formed within or bellow the upper surface of the foot bed and at least partially traversing the foot bed from an inlet aperture defined on an exterior of the tower surface of the base to an outlet aperture defined on the exterior of the lower surface of the base, the apertures providing ambient airflow into and out of the foot bed from the exterior of the base during use, wherein the ventilation channel is in moisture transport communication with the interior of the upper shoe portion, thereby providing ventilation and moisture transfer from the received foot to the channel and out the outlet aperture.

2. The ventilated sport shoe of claim 1, wherein the upper shoe portion is configured for ventilation of upper portions of the foot.

3. The ventilated sport shoe of claim 2, wherein the upper shoe portion is constructed of a breatheable material.

4. The ventilated sport shoe of claim 1, wherein the inlet aperture is defined by the base and is longitudinally spaced from the outlet aperture relative to a longitudinal axis of the base.

5. The ventilated sport shoe of claim 4, wherein the inlet aperture is defined adjacent a toe portion of the base and the outlet aperture is defined adjacent a heel portion of the base.

6. The ventilated sport shoe of claim 5, wherein the inlet and outlet apertures and the ventilation channel are configured to provide continuous airflow therebetween for the length of the sport shoe, thereby providing ventilation and moisture transfer for substantially the entire length of the foot.

7. The ventilated sport shoe of claim 5, further comprising at least one branch ventilation channel extending from a branch inlet aperture, defined on the exterior of the base between the toe portion and the heel portion, rearwardly to join the ventilation channel.

8. The ventilated sport shoe of claim 7, further comprising a plurality of branch ventilation channels.

9. The ventilated sport shoe of claim 1, wherein the lower surface of the base defines a projection projecting downwardly from the lower surface, the inlet ventilation aperture being defined within the projection.

10. The ventilated sport shoe of claim 9, wherein the inlet ventilation aperture is disposed on a forward face of the projection, such that the forward face is orientated towards a toe portion of the base.

11. The ventilated sport shoe of claim 10, wherein the inlet ventilation aperture is positioned normal to the freestream airflow through the ventilation channel, thereby drawing airflow through the channel.

12. The ventilated sport shoe of claim 1, wherein the ventilation channel comprises a plurality of channels at least partially traversing the upper surface of the foot bed providing airflow into and out of the foot bed for corresponding portions of the foot bed during use.

13. The ventilated sport shoe of claim 12, wherein the plurality of ventilation channels are arranged to ventilate at least a majority of the upper surface of the foot bed.

14. The ventilated sport shoe of claim 12, wherein the plurality of channels are disposed substantially parallel to a longitudinal axis of the foot bed.

15. The ventilated sport shoe of claim 12, wherein the plurality of channels are arranged over or within substantially the entire width of the upper surface of the foot bed.

16. The ventilated sport shoe of claim 12, wherein the plurality of channels extend from a corresponding plurality of inlets defined on the exterior of the base to a corresponding plurality of outlets defined on the exterior of the base.

17. The ventilated sport shoe of claim 1, wherein the ventilation channel is configured for at least a portion of its length as a groove formed in the upper surface of the base.

18. The ventilated sport shoe of claim 1, wherein the ventilated sport shoe is adapted for use as an in-line skate shoe, further comprising a lower frame secured to the base and a plurality of longitudinally aligned wheels mounted on the lower frame.

19. The ventilated sport shoe of claim 1, wherein the ventilation channel is defined in the base and the foot bed further comprises a substrate received within the upper shoe portion between an upper surface of the base and a user's foot, the substrate defining a plurality of moisture transport pathways in fluid communication with the ventilation channel.

20. The ventilated sport shoe of claim 19, wherein the substrate comprises a last board received on the upper surface of the base and joining the upper shoe portion to the base.

21. The ventilated sport shoe of claim 20, wherein the last board defines a plurality of apertures vertically extending therethrough at least partially aligned and in fluid communication with the ventilation channel.

22. The ventilated sport shoe of claim 20, wherein the substrate further comprises an insole received within the interior of the upper shoe portion over the last board.

23. The ventilated sport shoe of claim 22, wherein the insole is formed of a material that wicks moisture away from the foot toward the last board.

24. The ventilated sport shoe of claim 22, wherein the insole defines a plurality of apertures vertically extending therethrough.

25. The ventilated sport shoe of claim 24, wherein the apertures in the insole at least partially vertically align with the apertures of the last board and the ventilation channel of the base, providing unobstructed vertical passages for ventilation and moisture transfer.

26. The ventilated sport shoe of claim 1, wherein the base includes an inlay insertable into an upper surface thereof.

27. The ventilated sport shoe of claim 26, wherein the inlay is constructed of an elastomeric material.

28. The ventilated sport shoe of claim 27, wherein the inlay defines an upper surface capable of supporting the received heel of the foot and a lower surface defining a portion of the ventilation channel.

29. The ventilated sport shoe of claim 28, wherein the lower surface of the inlay defines a groove that defines a portion of the ventilation channel extending therethrough.

30. The ventilated sport shoe of claim 29, wherein the inlay defines a plurality of vertically extending apertures at least partially aligned with the groove providing ventilation through the inlay to the groove.

31. An in-line skate including a plurality of wheels, comprising:

an upper shoe portion defining an interior adapted to surround a user's foot;

a foot bed including a base secured to the upper shoe portion, the foot bed having an upper surface that supports the user's foot and the base having an exterior surface, wherein the base defines inlet and outlet ventilation apertures on the exterior surface of the base, and the foot bed defines a channel extending from the inlet to the outlet aperture and at least partially along the upper surface of the foot bed to provide ambient airflow into and out of the foot bed from the exterior of the base during use;

moisture transport means for placing the channel in moisture transport communication with the interior of the upper shoe portion, such that motion of the skater during use causes airflow from the inlet aperture through the channel to the outlet aperture to draw moisture from the interior of the skate; and a frame for mounting the plurality of wheels secured to the exterior of the base.

32. A ventilated sport shoe base having an upper shoe portion adapted to receive a foot and a lower load-bearing surface, wherein the ventilated sport shoe comprises:

a base adapted to receive the upper shoe portion, the base defining an upper surface capable of receiving the foot and a lower surface capable of mounting the load-bearing surface, the base defining a ventilation channel at least partially traversing the upper surface of the base from an inlet aperture to an outlet apertures, the inlet and outlet apertures being defined on an exterior of the base to provide ambient airflow into and out of the base from the exterior of the base during use; and a substrate received within the upper shoe portion on the upper surface of the base and including a plurality of moisture transport pathways therethrough wherein air can flow from the aperture, through the ventilation channel, and out the outlet aperture, drawing moisture from the foot through the moisture transport pathways.

33. A ventilated skate having an upper shoe portion adapted to receive a skater's foot and a lower frame portion including a plurality of longitudinally aligned wheels rotatable about an axis normal to the longitudinal axis of the skate, wherein the ventilated skate further comprises:

a base adapted to receive the upper shoe portion, the base defining an upper surface capable of receiving the foot and a lower surface capable of mounting the lower frame portion, the base defining a ventilation channel at least partially traversing the upper surface of the base from an inlet aperture to an outlet aperture, the inlet and outlet apertures defined on an exterior of the lower surface of the base to provide ambient airflow through the base from outside the skate during use;

a substrate received within the upper shoe portion on the base and including a plurality of moisture transport pathways therethrough, wherein air flows from the inlet aperture, through the ventilation channel, and out the outlet aperture, drawing moisture from the foot through the moisture transport pathways; and an elastomeric inlay insertable into the upper surface of the base, the inlay defining an upper surface capable of supporting the heel of the skater's foot and a lower surface defining at least a portion of the ventilation channel, the inlay defining vertically extending apertures placing the channel in airflow communication with the upper surface of the inlay.

34. A ventilated sport shoe including a lower frame portion mounting a bearing member, wherein the ventilated sport shoe comprises:

an upper shoe portion defining an interior adapted to receive a foot; and a foot bed including a base secured to the upper shoe portion, the foot bed defining an upper surface capable of receiving the foot and the base defining a lower surface capable of mounting the lower frame thereon, the foot bed defining a ventilation channel formed within or below the upper surface of the foot bed and at least partially traversing the foot bed from an inlet aperture defined on an exterior of the base to an outlet aperture defined on the exterior of the base, the apertures providing airflow into and out of the foot bed during use, wherein the ventilation channel is in moisture transport communication with the interior of the upper shoe portion, thereby providing ventilation and moisture transfer from the received foot to the channel and out the outlet aperture wherein the lower surface of the base defines a projection projecting downwardly from the lower surface, the inlet ventilation aperture being defined within the projection.

35. The ventilated sport shoe of claim 34, wherein the inlet ventilation aperture is disposed on a forward face of the projection, such that the forward face is oriented towards a toe portion of the base.

36. The ventilated sport shoe of claim 35, wherein the inlet ventilation aperture is positioned normal to the freestream airflow through the ventilation channel, thereby drawing airflow through the channel.

37. A ventilated sport shoe including a lower frame portion mounting a bearing member, wherein the ventilated sport shoe comprises:

an upper shoe portion defining an interior adapted to receive a foot; and a foot bed including a base secured to the upper shoe portion, the foot bed defining an upper surface capable of receiving the foot and the base defining a lower surface capable of mounting the lower frame thereon, the foot bed defining a ventilation channel formed within or below the upper surface of the foot bed and at least partially traversing the foot bed from an inlet aperture defined on an exterior of the base to an outlet aperture defined on the exterior of the base, the apertures providing airflow into and out of the foot bed during use, wherein the ventilation channel is in moisture transport communication with the interior of the upper shoe portion, thereby providing ventilation and moisture transfer from the received foot to the channel and out the outlet aperture, wherein the base includes an inlay insertable into an upper surface thereof, wherein the inlay is constructed of an elastomeric material, wherein the inlay defines an upper surface capable of supporting the received heel of the foot and a lower surface defining a portion of the ventilation channel, wherein the lower surface of the inlay defines a groove that defines a portion of the ventilation channel extending therethrough.

38. The ventilated sport shoe of claim 37, wherein the inlay defines a plurality of vertically extending apertures at least partially aligned with the groove providing ventilation through the inlay to the groove.

* * * * *

UNITED STATES PATENT AND TRADEMARK OFFICE

CERTIFICATE OF CORRECTION

PATENT NO. : 5,797,610
DATED : August 25, 1998
INVENTOR(S) : D.H. Grande et al.

It is certified that error appears in the above-identified patent and that said Letters Patent is hereby corrected as shown below:

| COLUMN | LINE | |
|---|---|---|
| 7 (Claim 1, | 32 line 11) | "bellow" should read --below-- |
| 7 (Claim 1, | 34 line 13) | "tower" should read --lower-- |
| 9 (Claim 32, | 49 line 9) | "apertures" should read --aperture-- |
| 9 (Claim 32, | 57 line 16) | before "aperture", please insert --inlet-- |
| 10 (Claim 34, | 43 line 21) | after "aperture" please insert --,-- |

Signed and Sealed this

Thirteenth Day of July, 1999

*Attest:*

*Attesting Officer*

Q. TODD DICKINSON

*Acting Commissioner of Patents and Trademarks*

Adverse Decision In Interference

Patent No. 5,797,610, Dodd H. Grande, Antonin A. Melbock, John E. Svensson, Antonin A. Meibock, John E. Svensson, VENTILATED IN-LINE SKATE, Interference No. 105,283, final judgment adverse to the patentees rendered, September 29, 2005, as to claims 1-38.

*(Official Gazette, February 28, 2006)*